US006494615B2

(12) United States Patent
Wyssbrod

(10) Patent No.: US 6,494,615 B2
(45) Date of Patent: Dec. 17, 2002

(54) CONTROL DEVICE WITH A SNAP FUNCTION AND WATCH FITTED THEREWITH

(75) Inventor: Baptist Wyssbrod, Bienne (CH)

(73) Assignee: ETA SA Fabriques d'Ebauches, Grenchen (CH)

( * ) Notice: Subject to any disclaimer, the term of this patent is extended or adjusted under 35 U.S.C. 154(b) by 21 days.

(21) Appl. No.: 09/874,030

(22) Filed: Jun. 6, 2001

(65) Prior Publication Data

US 2001/0050884 A1 Dec. 13, 2001

(30) Foreign Application Priority Data

Jun. 7, 2000 (CH) ..... 1119/00

(51) Int. Cl.[7] ..... G04B 29/00; H01H 13/14; H01H 15/00

(52) U.S. Cl. ..... 368/319; 368/320; 200/341; 200/520; 200/537

(58) Field of Search ..... 368/288–290, 368/319–321; 200/329, 341, 345, 520, 530, 532, 535, 537

(56) References Cited

U.S. PATENT DOCUMENTS 3,928,741 A 12/1975 Comer
4,218,599 A * 8/1980 Garn ..... 200/159 R
4,320,481 A * 3/1982 Hofert ..... 368/190

FOREIGN PATENT DOCUMENTS

| | | |
|---|---|---|
| DE | 2 360 167 | 6/1975 |
| FR | 1 157 462 | 5/1958 |
| FR | 2 335 930 | 7/1977 |

* cited by examiner

*Primary Examiner*—Vit Miska
(74) *Attorney, Agent, or Firm*—Sughrue Mion, PLLC

(57) ABSTRACT

A control device with a snap function includes a support (10), a push-button (12) mounted so as to move in translation along an axis on the support, and a spring element (14) which is not secured to the support or to the push-button. The spring element (14) is formed of an elongated sheet made of resilient material, inserted between the push-button (12) and the support (10), and includes a pair of support zones (36) located at its ends and at least a median support zone arranged in its central portion. These support zones cooperate respectively with the head (28) of the push-button and with a raised surface **(24*c*)** of the support. In the rest position, the sheet has a bent or V-shaped cross section, which can deform to create a snap action during the travel of the push-button which tends to bend the spring element longitudinally. Such a device can be applied to control a mechanical or electrical function of a watch or another apparatus of small size.

10 Claims, 2 Drawing Sheets

CONTROL DEVICE WITH A SNAP FUNCTION AND WATCH FITTED THEREWITH

The present invention relates to a control device with a snap function, including a support, a push-button mounted so as to move on the support so as to have a translation travel along one axis, and a spring element able to exert a reactive force on the push-button which passes through a maximum during the travel of the push-button. The invention also concerns a watch including a case and a control device of this type.

Such a control device, also called a snap action control device, can be used in particular to activate a contact strip of an electric switch, particularly to control functions of a portable electronic device. However, the push-button of such a device may also produce a purely mechanical command.

Such devices are used, for example, to control the stop and start functions of mechanical or electric chronograph watches. The snap function means that the push-button remains without effect as long as the pressure exerted does not exceed a limit value for the reactive force, then once the limit is exceeded, the devices abruptly changes state, since the pressure necessary to end the function is less than this limit value. It is thus possible to start or stop a counter with precision.

In such known watches, the parts assuring the snap function usually form part of the chronograph mechanism and are secured onto a bridge or the plate of the movement. The force to be overcome is generated by a jumper-spring type device, with a spring working by bending, which cooperates with a cam, as provided for example by Swiss Patent No. 642 220. Devices of this type require significant volume, which is a considerable handicap in a watch.

Making snap function push-buttons wherein this function is assured by a spring element mounted on the case or push-button has also been proposed. A solution of this kind is shown in Swiss Patent No. 629 647. In this document, the spring element is made by means of an annular part, which can be deformed radially, which slides over a cam surface and passes over a raised portion of said surface. Such a solution does not require much space, but it is difficult to control the trigger point and the force to be applied to assure the function.

Control devices using snap springs to generate a snap action are also known in the specific field of electric switches. A compact type of snap spring, illustrated for example in U.S. Pat. No. 4,234,769, is formed by a flexible straight strip which is held bent longitudinally by compression between two fixed stops. However, this spring has two stable positions and in a push button control, this requires an additional return spring. Another drawback is that the permanent compression requires quite a robust support which may constitute an inconvenient element in a small apparatus such as a watch.

These drawbacks may be partially overcome by incorporating the compression bent strip in a larger plate spring which forms a frame around it and which will itself be bent by the push-button for example as shown in U.S. Pat. No. 5,075,524. However, this system requires a relatively large course for the push-button and thus proves too cumbersome in an apparatus as small as a watch. Further, the securing of this spring element also requires a robust support and a certain space requirement.

One object of the present invention is to make a simple and compact control device having a snap function.

Additionally, the device should be easy to manufacture and mount and reliable during operation.

The present invention therefore concerns, according to a first aspect, a control device with a snap function of the type indicated in the preamble, characterized in that the spring element includes an elongated sheet made of resilient material, inserted between the push-button and the support and having at least a median zone arranged in its central portion and at least a pair of support zones located at the ends of said sheet, the pair of support zones and the median zone being intended to abut one against the push-button and the other against the support so that the travel of the push-button tends to bend said sheet longitudinally, and in that said sheet has a bent or V-shaped cross section in the rest position.

One advantage of this arrangement is that the spring element does not need to be rigidly secured to the support, which thus does not have to be particularly robust. The support zones of the spring element need only be held at the correct place, for example by the push-button or as a result of a housing in which the element is freely encased.

In fact, the spring element does not need to be secured either to the support or to the push-button. Another advantage is that an element of this type can be very small, in particular not larger than the head of the push-button and that the device assembly can be manufactured and mounted at a very low price.

Preferably, in order to assure good working conditions for the push-button and the spring element, the latter includes, in its central portion, an orifice through which a push-button stem passes.

In a preferred embodiment, said pair of support zones is located on a concave face, and the median zone on a convex face of the spring element. Advantageously, the support abuts against the concave face and the push-button against the convex face.

In order to guarantee that the working conditions remain the same during the life of the product, it is desirable for the spring element to be positioned with respect to the support and the push-button. It therefore includes cut out portions in proximity to its opposite ends in contact with the push-button. Further, the latter is provided with protrusions engaged in these cut out portions to assure the relative positioning of the spring element and the push-button. The push-button itself may be guided in a conventional manner with respect to the support.

Good manufacturing conditions have been obtained when the shape of the spring element includes two plane walls connected to each other by a rounded portion. This structure further allows a clearly defined snap action to be guaranteed and the force to be applied to be well controlled, so that, for a same model, it is practically the same from one piece to another.

The present invention also relates to a watch provided with a case and a control device as defined hereinabove. In this watch, the case forms the support for the control device, the push-button includes a head arranged outside the case and a stem engaged in a hole in the case and opening out inside the case. The spring element is arranged in a recess of an outer face of the case and cooperates with the push-button head.

The thickness of watches has an important role from the aesthetic point of view. In order to reduce this thickness as much as possible while having push-buttons which are easy to handle, both the push-button head and the spring element of the control device can be of elongated, preferably oval shape.

Other advantages and features of the invention will appear from the following description of a preferred embodiment, with reference to the annexed drawings, in which.

Figure 1:
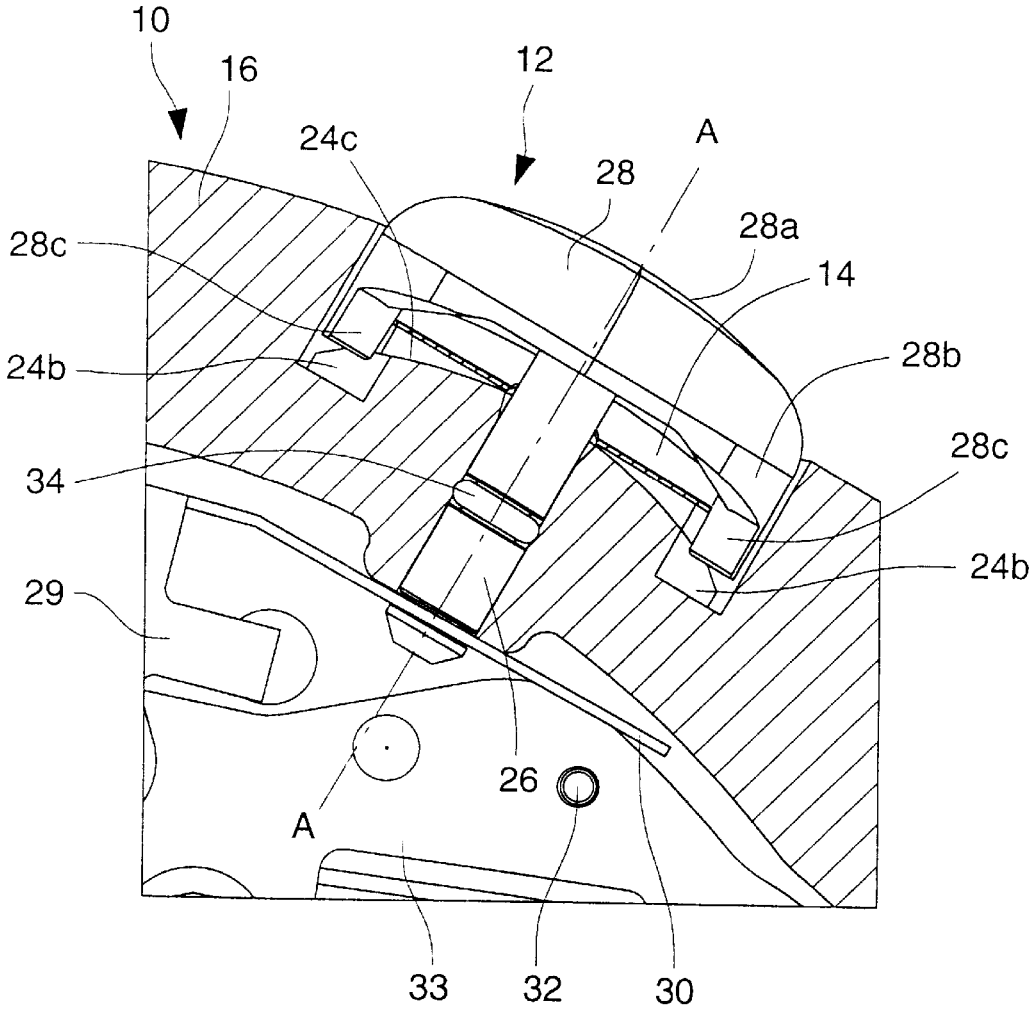
FIG. 1 is a partially cut away plan view of a portion of a watch case fitted with at least a push-button control device according to the invention.
Figure 2:
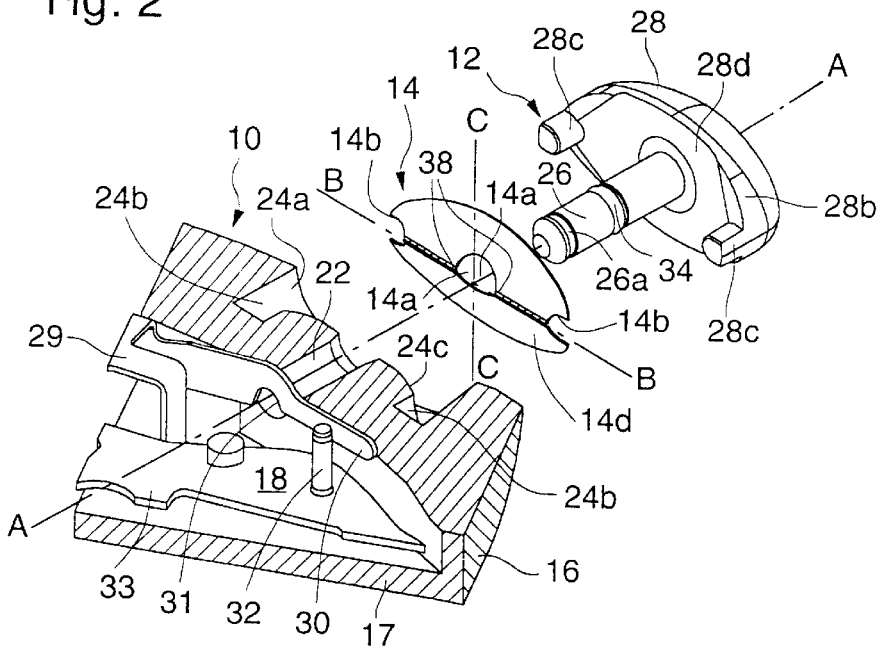
FIG. 2 is an exploded perspective view of the object of FIG. 1.
Figure 3:
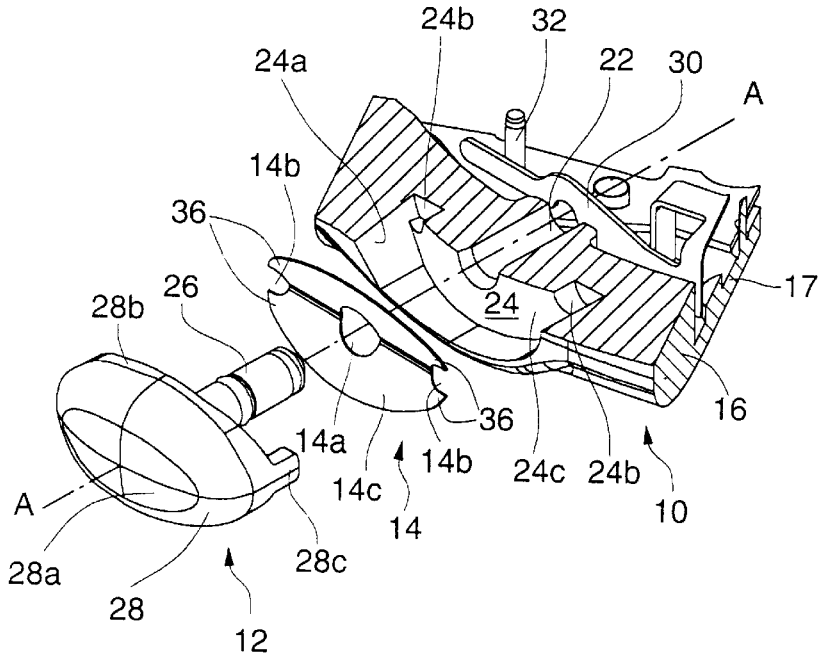
FIG. 3 is a similar view to FIG. 2 but from another angle.

The device shown in the drawing includes a support formed of a watch case 10, a push-button 12 mounted so as to move in translation along an axis A-A in case 10, and a spring element 14 inserted between case 10 and push-button 12.

Case 10 can be made of any solid material, for example metal or plastic. It includes a middle part 16 and a back cover 17, which define a housing 18 in which is arranged a watch movement 20. In the watch described here, back cover 17 forms the bottom plate of movement 20. Middle part 16 is pierced with a cylindrical hole 22 whose axis, which merges with axis A-A, is oriented radially, connecting housing 18 to the outside of case 10. In proximity to hole 2, middle part 16 includes on its outer surface an elongated recess 24 the lateral wall 24*a* of which is for example in the shape of an oval cylinder. The bottom of recess 24 includes two opposite indentions 24*b* adjacent to wall 24*a*, and a raised central portion 24*c* which has the shape of a spherical cap the center of which is located on axis A-A of push-button 12.

Push-button 12 includes a cylindrical stem 26, preferably made of metal, engaged in hole 22, and a head 28 advantageously made of plastic, secured to stem 26 by overmoulding and arranged outside case 10. Stem 26 has a slightly smaller diameter to that of hole 22, so that it can slide therein freely. It is provided with two grooves 26*a* and 26*b* arranged so that, when push-button 12 is in place, groove 26*a* is located inside housing 18, flush with the inner wall of middle part 16, and groove 26*b* in the median portion of hole 22.

A strip-spring 30, forming part of a metal part 29 secured to the movement and connected to one of the poles of the electric battery powering movement 20, includes a notch 31 to engage result in groove 26*a* and thus prevent push-button 12 from being removed from hole 22. It also assures an electric contact function, its free end being applied against a pin 32 of a printed circuit board 33 secured to back cover 17, when push-button 12 is pressed sufficiently, as will be explained later.

An O-ring sealing gasket 34 arranged in groove 26*b* is in contact with the wall of hole 22 over its entire periphery, to assure the sealing of the passage of push-button 12 in hole 22 of middle part 16.

Head 28 of push-button 12 has an elongated shape which corresponds to that of recess 24, so that it can slide therein but without being able to rotate. It has here a cap shape having a raised outer portion 28*a*, secured to stem 26, and an oval cylindrical portion 28*b* extending from the outer portion in the direction of middle part 16, inside recess 24. Head 28 has a concave inner surface 28*d* in the shape of a section of cone. Cylindrical portion 28*b* is provided, on its inner face, with two protrusions formed by fingers 28*c* extending respectively from the head to the inside of each indention 24*b* the function of which will be explained hereinafter.

Spring 14 is formed of a thin stainless steel sheet, of generally oval shape provided at its center with a round orifice 14*a* the diameter of which is slightly greater than that of stem 26, so that the latter can slide freely therein. The oval shape has a major axis B-B and a minor axis C-C, these axes being perpendicular to each other and perpendicular to axis A-A of hole 22.

The sheet forming spring 14 is indented at both ends of the large side of the oval, to form cut out portions 14*b* intended to accommodate fingers 28*c*. It is bent or folded so as to have a shape inscribed on a geometrical surface generating line by a generator parallel to longitudinal axis B-B, with a concave face 14*c* and a convex face 14*d*.

In the embodiment shown in the drawings, the spring has the general shape of a roof which has two plane walls connected to each other by a rounded portion, thus forming a substantially V-shaped cross section. It should be noted that the spring has a rotational symmetry around axis A-A, as well as symmetry with respect to its median longitudinal plane passing through the axes A-A and B-B.

Spring element 14 is arranged in recess 24, so that stem 26 passes through it via orifice 14*a* when it is engaged in hole 22 and so that its concave face 14*c* abuts against head 28, on at least a pair of support zones 36 located in proximity to the ends of its oval shape, while its convex face 14*d* abuts against central portion 24*c* of the support via at least a median zone 28 in proximity to the push-button stem. Spring element 14 is positioned relative to push-button 12 via the engaging of fingers 28*c* in cut out portions 14*b*, so that it does not rub against lateral wall 24*a*.

In the example shown, the support zones of spring 14 against head 28 are located along the edges of cut out portions 14*b*. In the initial position shown in FIG. 1, there are in fact two of these support zones 36 on either side of each cut out portion 14*b*. The convex face of the central portion of spring 14 abuts against case 10 on two median zones 38 located on either side of orifice 14*a*.

When the user of a watch fitted with a device as described above activates push-button 12, it exerts manual pressure on head 28 which tends to make stem 26 penetrate case 10. Head 28 abuts, in proximity to its fingers 28*c*, against concave face 14*c* of spring 14, more precisely on the two pairs of support zones 36 located at the ends of spring 14, whose median zones 38 abut against raised central portion 24*c* of housing 24. The pressure thus generates a force which tends to deform spring 14.

Consequently, spring 14 acts like a beam which is pressed in its median portion and subjected to a force at both of its ends. Via the effect of the manual pressure on the push-button, the beam tends to bend on the one hand in the direction of its length, but also to flatten out in its transverse direction C-C because of the traction stress which acts along its two edges parallel to B-B. In other words, the bent or V-shape of the spring tends to open out. Since the arrangement of the spring and its support zones is symmetrical with respect to its median longitudinal plane, the stress and deformation are also symmetrical and do not require any securing means to stabilize the spring.

The reaction force of the beam is a function of its deflection and the static moment of inertia of its cross section. This moment of inertia is higher the more the V is closed. In other words, by subjecting the beam to sufficient force, the V spreads out during the travel of the push-button, which reduces the static moment of inertia. A moment arrives beyond which the force necessary to make the beam bend decreases when the deflection increases. Once this point is passed, maintaining pressure causes the push-button to be pushed in hard, which generates the snap function. Strip spring 30 then enters abruptly into contact with pin 32, thus assuring the desired electric contact.

The transverse spacing between the two support zones 36 at each end of spring 14 also contributes to flattening out its cross section, but this complementary effect is not indispensable.

When the push-button is released it returns to its place by itself, via the joint action of spring 14 and strip spring 30. As spring 14 provides a return force over the entire travel of the push-button, the force of strip spring 30 is not indispensable. The latter could also be returned by spring 14, via stem 26.

Tests performed have shown that with a spring 14 made from 0.06 mm thick sheet steel, with a width of 3.50 mm, an active length of 5.00 mm (defined by the distance between the two cut out portions 14*b*), a central hole 14*a* with a diameter of 1.40 mm and an V opening equal to 140°, the force to be applied to the push-button is equal to approximately 7 N.

It will easily be understood that spring 14 described hereinabove may not only be manufactured at little cost, but it is also very easy to assemble and does not require the support to be very robust, since the greatest force which can be applied to it is the pressure on the push-button. If this pressure exceeds the maximum reactive force of the spring, it will be absorbed by fingers 28*c* abutting against the watch case.

It is clear that the embodiment described is only one variant amongst many. The spring element could be turned over if the corresponding support surfaces of the case and the push-button are reversed. Numerous other solutions can be envisaged. The spring element could for example have a round or rectangular shape, or even have a warped surface. In every case, the static moment of inertia has to decrease when the element is subjected to a bending force. This condition is met when the cross section of the element along a plane defined by the axes A-A and C-C, which is perpendicular to axis B-B along which the bending occurs, is bent in a rest position, i.e. when the element is not subjected to resilient deformation.

The spring element could also be arranged inside the case, or even in a housing made in the case and intended for this purpose. On the other hand, the spring element could be extended by one or more strips themselves forming the electric contact instead of strip spring 30.

The device could also be used for push-buttons used in different apparatus to watches, for example telephones or computers.

What is claimed is:

1. A control device with a snap function, including a support, a push-button mounted so as to move on the support so as to have a travel in translation along an axis (A-A), and a spring element able to exert a reactive force on said push-button, said reactive force passing through a maximum-during the travel of the push-button, wherein said spring element includes a sheet made of resilient material, inserted between said push-button and said support and having at least a median zone arranged in its central portion and at least a pair of support zones located at the ends of said sheet, said pair of support zones and said median zone being intended to abut one against said push-button and the other against said support so that the travel of said push-button tends to bend said sheet along a longitudinal axis (B-B), and wherein said sheet has a bent or V-shaped cross section in a rest position of said spring element.

2. A control device according to claim 1, wherein said spring element is not secured to said support or to said push-button.

3. A control device according to claim 1, wherein said spring element includes in its central portion an orifice through which a stem of said push-button passes.

4. A control device according to claim 1, wherein said pair of support zones is located on a concave face, and said median zone on a convex face of said spring element.

5. A control device according to claim 4, said concave face of said spring element abuts against said support, and wherein said convex face of said spring element abuts against the push-button.

6. A control device according to claim 5, wherein said spring element includes cut out portions in proximity to its opposite ends and wherein said push-button includes protrusions engaged in said cut out portions to assure relative positioning of said spring element and said push-button.

7. A control device according to claim 4, wherein said spring element is symmetrical with respect to its longitudinal plane passing through the axis of the push-button.

8. A control device according to claim 4, wherein said spring element includes two plane walls connected to each other by a rounded portion.

9. A watch including a case and a control device according to claim 1, wherein:

said case forms the support of said control device;

said push-button includes a head arranged outside said case, and a stem engaged so as to slide in a hole of said case and opening out inside (28) the latter; and said spring element is arranged in a recess of an outer face of said case and cooperates with a head of said push-button.

10. A watch according to claim 9, wherein said head of said push-button and said spring element both have an elongated shape, in particular an oval shape.

* * * * *